US011143178B2

(12) United States Patent
Paweletz et al.

(10) Patent No.: US 11,143,178 B2
(45) Date of Patent: Oct. 12, 2021

(54) PISTON PUMP

(71) Applicant: Robert Bosch GmbH, Stuttgart (DE)

(72) Inventors: Anton Paweletz, Fellbach (DE); Dietmar Kratzer, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 303 days.

(21) Appl. No.: 16/082,069

(22) PCT Filed: Feb. 17, 2017

(86) PCT No.: PCT/EP2017/053696
§ 371 (c)(1),
(2) Date: Sep. 4, 2018

(87) PCT Pub. No.: WO2017/153153
PCT Pub. Date: Sep. 14, 2017

(65) Prior Publication Data

US 2020/0309117 A1 Oct. 1, 2020

(30) Foreign Application Priority Data

Mar. 9, 2016 (DE) ..... 10 2016 203 847.8

(51) Int. Cl.
*F04B 53/16* (2006.01)
*F04B 5/02* (2006.01)
(Continued)

(52) U.S. Cl.
CPC ..... *F04B 53/16* (2013.01); *F04B 5/02* (2013.01); *F04B 17/044* (2013.01); *F04B 53/14* (2013.01)

(58) Field of Classification Search
CPC ..... F04B 5/02; F04B 17/044; F04B 53/10; F04B 53/14; F04B 53/16; F04B 17/04; F04B 17/042; F04B 53/162; F04B 53/22
(Continued)

(56) References Cited

U.S. PATENT DOCUMENTS 2,283,886 A * 5/1942 Henkell ..... H02K 33/10 310/34
2,833,220 A * 5/1958 Robinson ..... F04B 17/044 417/418
(Continued)

FOREIGN PATENT DOCUMENTS

DE 29 03 817 A1 8/1980
DE 2903817 A1 * 8/1980 ..... F04B 17/042
(Continued)

OTHER PUBLICATIONS

International Search Report corresponding to PCT Application No. PCT/EP2017/053696, dated May 10, 2017 (German and English language document) (7 pages).

*Primary Examiner* — Charles G Freay
*Assistant Examiner* — Chirag Jariwala
(74) *Attorney, Agent, or Firm* — Maginot, Moore & Beck LLP

(57) ABSTRACT

A piston pump, in particular for a motor vehicle, includes a piston that is movably mounted in a housing. The piston pump further includes a linear actuator for moving the piston in a first direction. The piston pump further includes a return spring for moving the piston in a second direction. The end face of a first end of the piston delimits a first pressure chamber that is associated with a first hydraulic circuit. The end face of a second end of the piston delimits a second pressure chamber.

10 Claims, 2 Drawing Sheets

(51) Int. Cl.
*F04B 17/04* (2006.01)
*F04B 53/14* (2006.01)

(58) Field of Classification Search
USPC ..... 417/267, 417, 418
See application file for complete search history.

(56) References Cited

U.S. PATENT DOCUMENTS

| | | | | | |
|---|---|---|---|---|---|
| 2,872,101 | A * | 2/1959 | Ryba | F04B 35/045 | 417/418 |
| 3,053,194 | A | 9/1962 | Webster | | |
| 4,787,823 | A * | 11/1988 | Hultman | F04B 17/046 | 310/27 |
| 6,290,308 | B1 * | 9/2001 | Zitzelsberger | F04B 17/042 | 303/116.4 |
| 2006/0127251 | A1 * | 6/2006 | Okubo | F04B 17/044 | 417/418 |

FOREIGN PATENT DOCUMENTS

| | | | | | |
|---|---|---|---|---|---|
| DE | 10 2013 214 216 | A1 | | 2/2014 | |
| DE | 102013214216 | A1 | * | 2/2014 | |
| DE | 10 2013 218 064 | A1 | | 6/2014 | |
| DE | 10 2013 218 068 | A1 | | 6/2014 | |
| GB | 638585 | | | 6/1950 | |
| JP | 2001-41147 | A | | 2/2001 | |
| JP | 2001-41148 | A | | 2/2001 | |
| JP | 2001041147 | A | * | 2/2001 | F04B 9/00 |
| JP | 2001041148 | A | * | 2/2001 | |
| JP | 2005-180332 | A | | 7/2005 | |
| JP | 2008-101788 | A | | 5/2008 | |
| JP | 2008101788 | A | * | 5/2008 | |
| JP | 2015-530513 | A | | 10/2015 | |

* cited by examiner

PISTON PUMP

This application is a 35 U.S.C. § 371 National Stage Application of PCT/EP2017/053696, filed on Feb. 17, 2017, which claims the benefit of priority to Serial No. DE 10 2016 203 847.8, filed on Mar. 9, 2016 in Germany, the disclosures of which are incorporated herein by reference in their entireties.

The disclosure concerns a piston pump, in particular for a motor vehicle, with a piston which is movably mounted in a housing, with a linear actuator for moving the piston in a first direction, and with a return spring for moving the piston in a second direction, wherein the end face of a first end of the piston delimits a first pressure chamber assigned to a first hydraulic circuit.

BACKGROUND

Piston pumps of the type cited initially are known from the prior art. Various systems in motor vehicles are actuated hydraulically. These include in particular vehicle braking systems which have one or more high-pressure pumps to support or generate the braking force, and serve for metering the brake pressure. Usually, these high-pressure pumps are formed as piston pumps in which a piston, which is movably mounted in a cylinder, is moved periodically or in reciprocating fashion by an actuator in order to periodically enlarge and reduce the volume of the pump chamber. The pump chamber is connected to a hydraulic circuit for example by one or two check valves, so that hydraulic medium is drawn into the pump chamber on a first movement of the piston and expelled again on a second movement. It is known to form the actuator for moving the piston as a linear actuator which is able to load the piston with an actuator force in a first movement direction. The movement force is generated by a magnetic force provided by a powered magnetic coil of the actuator. Because the piston can be moved thereby in one direction only, a return spring is also assigned to the piston which moves the piston back to the starting position after an actuation process.

The disadvantages of the known solution are the actuation force available, the actuation frequency, and the comparatively high energy consumption of the linear actuator. In particular in comparison with rotating electric motors, the energy consumption is increased, in particular because the piston must be accelerated alternately in different movement directions.

SUMMARY

The piston pump according to the disclosure with the features described herein has the advantage that the efficiency of the piston pump is increased, so that the advantages of a piston pump with linear actuator may also be utilized in a high-pressure application in the motor vehicle. Because of the linear actuator, the piston movement may be controlled by changing the amplitude and frequency independently of each other. In this way, a precise pressure build-up at the desired time can be reliably achieved. In contrast to a rotating electric motor as an actuator, noise and wear are also reduced. In particular, there are no weak points which restrict the service life, such as in particular ball-bearings and commutator or slip ring devices. The piston pump according to the disclosure also provides a pumping power which in particular meets the requirements of vehicle braking systems. According to the disclosure, this is achieved in that the end face of a second end of the piston delimits a second pressure chamber. Thus independently of the movement direction of the piston, a pumping and a suction process are performed by the movement of the piston into a respective pressure chamber. The delivery volume of the piston pump is thus doubled.

According to a preferred refinement of the disclosure, it is provided that the linear actuator has an armature fixedly connected to the piston, and a stator arranged stationarily on the housing, coaxially to the piston, wherein the stator lies between the two pressure chambers. The piston pump thus has a particularly compact form in which the stator, and hence the linear actuator, is arranged substantially between the two pressure chambers.

Furthermore, it is preferably provided that the second pressure chamber is assigned to the first hydraulic circuit. Thus the piston pump serves to generate a hydraulic pressure in a hydraulic circuit, wherein a pressure is generated in this hydraulic circuit independently of the movement direction of the piston. Thus both movement directions of the piston serve to fill the one hydraulic circuit and to generate a braking pressure for example. In comparison with conventional piston pumps therefore, because of the two pressure chambers, for example a pressure can be generated in the first hydraulic circuit twice as quickly as before. Alternatively, according to a further embodiment, it is preferably provided that the two pressure chambers are assigned to different hydraulic circuits, so that the second pressure chamber is or can be connected to a second hydraulic circuit. In this way, by means of the advantageous piston pump, a hydraulic pressure can be generated in two hydraulic circuits almost simultaneously.

According to a preferred refinement of the disclosure, it is provided that at least one check valve is assigned to each pressure chamber. Depending on the pressure conditions, the check valve automatically allows the supply into the pressure chamber or the outlet from the pressure chamber, while a backflow is securely prevented.

Preferably, each pressure chamber has a first check valve at an intake port and a second check valve at a pressure port, so that both the intake and the outlet may be regulated by automatic check valves. This gives a simple and compact construction of the piston pump.

Furthermore, it is preferably provided that the first pressure chamber is arranged in a first housing part and the second pressure chamber is arranged in a second housing part, wherein the two housing parts lie closely against each other, enclosing the linear actuator between them. The housing of the piston pump thus becomes a function part. It is substantially formed by two housing parts which each comprise one of the pressure chambers. Because the two housing parts lie against each other and enclose the linear actuator between them, firstly the linear actuator is securely held between the two housing parts with relatively simple geometries, and secondly in a simple fashion an advantageous tightness of the piston pump is guaranteed. Because of the simple geometric form, a precision (necessary at high pressure) can be achieved. Also, the piston pump is simple to install and construct. The two housing parts may be formed as housing halves or as different types of housing parts which are however formed complementarily to each other. In particular, it is provided that each of the housing parts receives at least regions of the linear actuator, in particular the stator of the linear actuator. For this, the respective housing part suitably has a depression adapted to the form of the stator in order to receive this by form fit and in particular snugly. In particular, the housing parts are configured such that in mounted state, the stator is clamped between the two housing parts so that a high tightness is guaranteed.

According to an advantageous refinement of the disclosure, it is also provided that the housing parts have mutually aligned bores which are each fluidically connected firstly to one of the pressure chambers and secondly to a consumer. The bores thus serve as fluid channels of the piston pump. Because the bores are formed aligned to each other, in particular the pressure chambers of the two housing parts can be connected together fluidically. In this way, it is possible in particular for both pressure chambers to be assigned to the same hydraulic circuit in order to jointly supply a consumer with hydraulic pressure. Because of the aligned formation or orientation of the bores, a simple and secure fluidic conduction from the one housing part to the other housing part is guaranteed.

Preferably, it is provided that at least one sealing element, in particular an O-ring, is assigned to the bores, which increases the tightness of the piston pump. In particular, the O-ring is arranged coaxially to the bores. In particular, the O-ring or sealing element lies between the two housing parts resting against each other, and is elastically deformed or pretensioned in order to achieve a particularly great sealing effect.

Furthermore, preferably it is provided that in the region of the bores, one of the housing parts has a protrusion and the other of the housing parts has a depression corresponding to the protrusion, so that on installation, the protrusion is inserted into the depression, creating a form-fit connection between the two housing parts. In addition, a type of labyrinth seal is created which further increases the tightness of the piston pump. The sealing element may, as described above, lie on the end faces between the two housing parts or lie between the casing wall of the protrusion and the casing wall of the depression in order to guarantee a radial seal.

Furthermore, it is preferably provided that the protrusion is held in the depression by force and/or form fit. The force fit is guaranteed for example by a press fit between the protrusion and the depression. The form fit is guaranteed in particular in that on installation, the protrusion and/or the depression is elastically deformed in order to create an undercut which securely holds the protrusion and depression against each other.

BRIEF DESCRIPTION OF THE DRAWINGS

The disclosure is explained in more detail below with reference to the drawing. The drawing shows.

DETAILED DESCRIPTION

Figure 1:
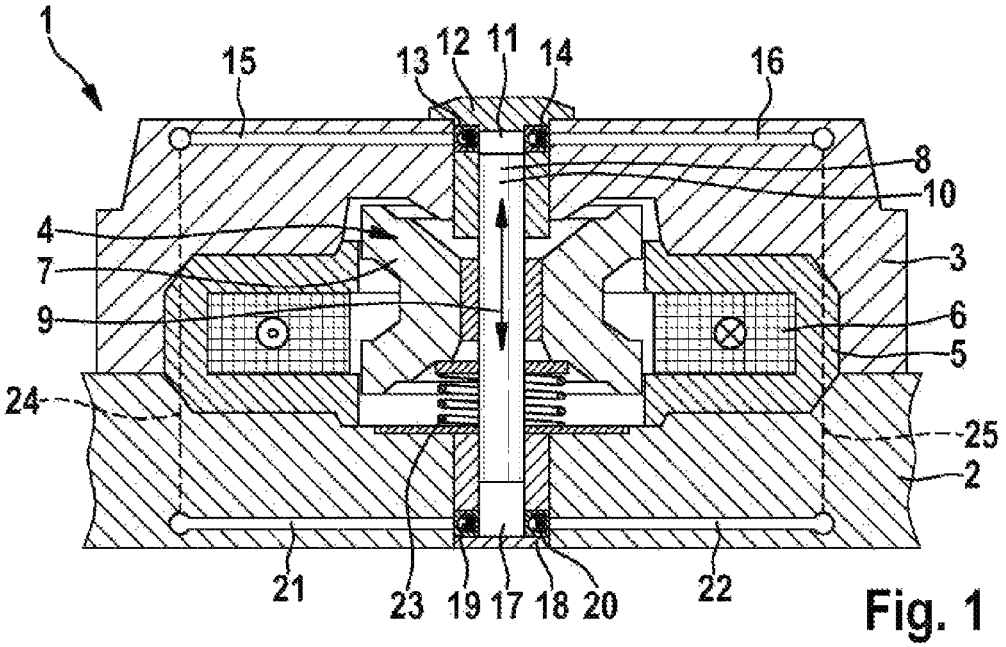
FIG. 1 a piston pump in a simplified longitudinal sectional depiction.

FIG. 1, in a simplified, longitudinal, sectional depiction, shows a piston pump 1 which has two housing parts 2 and 3 lying against each other, between which a linear actuator 4 is arranged. The linear actuator 4 has a stator 5 fixedly clamped between the housing parts, with a coil 6 which is able to be powered. Furthermore, the linear actuator 4 has an armature 7 which cooperates magnetically with the stator 5 and is fixedly connected to a piston 8 of the piston pump 1. The piston 8 is mounted movably in its longitudinal extension, i.e. axially, as indicated by a double arrow 9. A first end 10 of the piston 8 protrudes into a first pressure chamber 11 so that its end face delimits the volume of the pressure chamber 11.

The pressure chamber 11 is formed by an insert part 12 which is inserted in the housing part 3 and, with a beaker-like portion, forms the pressure chamber 11. Two check valves 13, 14 are arranged in the casing wall of the insert part 12, of which the one check valve 14 opens when the pressure in the pressure chamber 11 exceeds the pressure in a connected hydraulic channel 16, and the other check valve 13 opens in the direction of the pressure chamber 11 when the pressure in the pressure chamber 11 falls below a pressure in a hydraulic channel 15 leading to the pressure chamber 11. When the first end of the piston 8 protrudes into the pressure chamber 11, the hydraulic medium is pressed into the hydraulic channel 16 through the check valve 14. When the piston 8 is withdrawn from the pressure chamber 11, a reduced pressure is created in the pressure chamber 11 which draws hydraulic medium from the hydraulic channel 15 into the pressure chamber 11.

On the side of the piston 8 opposite the end 10, a further pressure chamber 17 is arranged in the housing part; a second end 18 of the piston 8 protrudes into said further pressure chamber 17 such that said second end 18 delimits the volume thereof. The pressure chamber 17 is also formed by an insert part 18 which is however inserted in the housing part 2. A check valve 19, 20 is arranged respectively on the inlet side and the outlet side in the casing wall of the beaker-like insert part 18, and is connected to a respective hydraulic channel 21, 22 in the housing part 2 in order as required to draw hydraulic fluid from the hydraulic channel 21 and deliver it to the hydraulic channel 22.

The piston pump 1 is thus configured as a double piston pump in which, independently of the movement direction of the piston, a hydraulic pressure is generated in one of the pressure chambers and at the same time a reduced pressure is generated in the other of the pressure chambers in order to draw in fresh hydraulic medium.

When the coil 6 is powered, a magnetic field is generated which moves the armature 7 and hence the piston 8 in the direction of the second pressure chamber 17. The armature 7 is displaced against the force of a return spring 23. When the return spring 23 is in the relaxed state, the armature 7 lies offset to the stator 5, so that by generation of the magnetic field the armature 7 is attracted and hence moved against the force of the spring element 23. As soon as the stator 5 is no longer powered or activated, the return spring 23 pushes the armature 7 back in the direction of the pressure chamber 11, whereby a further pumping process is performed there and a further suction process in the pressure chamber 17.

The linear actuator 4 is to this extent formed as a single-phase reluctance machine. The stator 5 with the coil 6 is arranged coaxially to the armature 7 or piston 8. The armature 7 is in particular made of a ferromagnetic material. The armature 7 is preferably also formed concentrically and separated from the stator by a small working air gap. In particular, all elements of the magnetic circuit or linear actuator 4 are arranged rotationally symmetrically about the piston axis of the piston 8 or piston pump 1. The housing parts 2, 3 are advantageously made of a non-magnetic material and carry the active elements, and thus structurally guarantee as precise a centrality as possible with a minimum air gap.

The coil 6 is powered and activated by a voltage source, for example an on-board network of a motor vehicle, by means of corresponding power electronics. The size of the voltage amplitude and the duration of the power supply determined by the power electronics determine both the deflection/amplitude of the armature 7 or the piston 8, and also its movement frequency. Preferably, the frequency is set in the region of the mechanical inherent frequency of the linear actuator 4.

The two pressure chambers 11, 17 may be connected to different hydraulic circuits. In the present case however, it is provided that the pressure chambers 17, 11 are or can be connected to the same hydraulic circuit. For this, the hydraulic channels 16 and 22, and the hydraulic channels 15 and 21, are respectively connected hydraulically together and to a consumer (not shown here). The merging of the channels 15 and 21, and of the channels 16 and 22, in this case takes place through bores 24, 25 in the housing parts 2, 3, which bores are formed parallel to the piston axis or movement direction of the piston 18.

Figure 2:
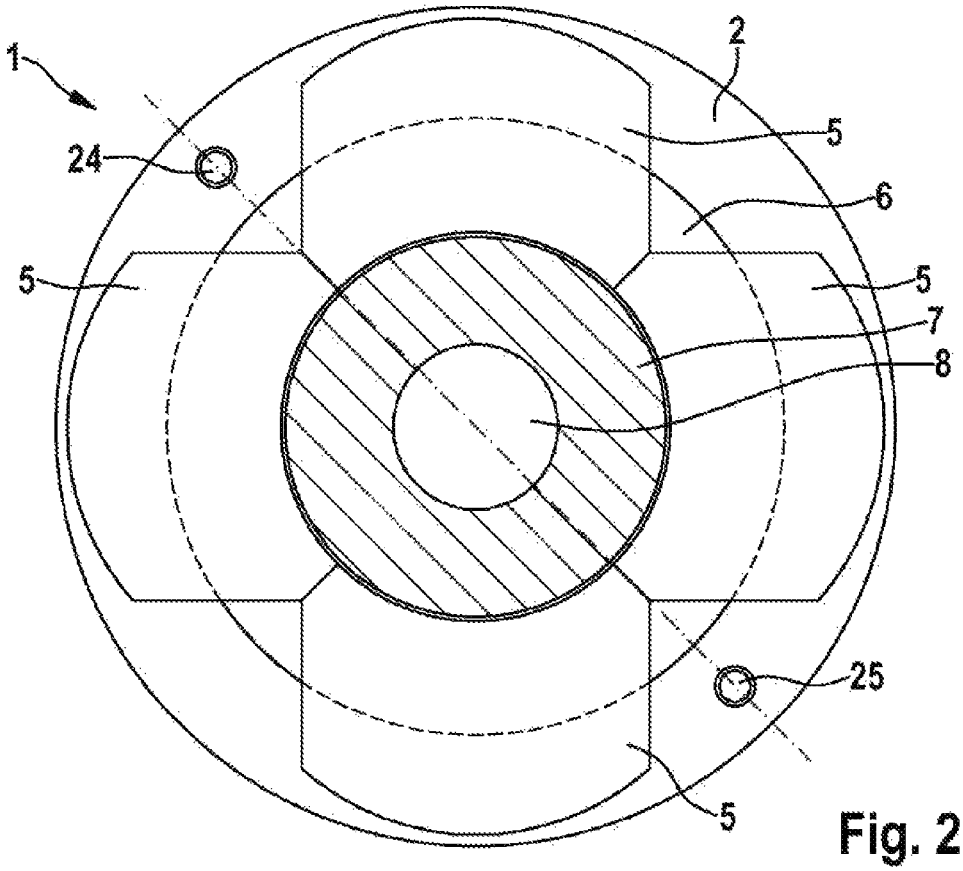
FIG. 2 the piston pump in a diagrammatic top view.

FIG. 2 here shows a simplified top view of the piston pump 1. The stator 5 and the coil 6 are shown, which are arranged or configured concentrically to the armature 7. Also, a narrow air gap between the stator 5 and the armature 7 can be seen. The piston 8 thus lies in the center of the piston pump 1. In the intermediate gaps of the stator packet or stator 5, two bores 24, 25 are shown as an example which extend parallel to the piston 8 and are formed in the housing parts 2 or 3. In FIG. 1, the bores 24, 25 are indicated by dotted lines. In order to allow a hydraulic connection or fluidic connection between the respective channels through the bores, these must be aligned with each other when the housing parts 2, 3 are in mounted state.

Figure 3A:
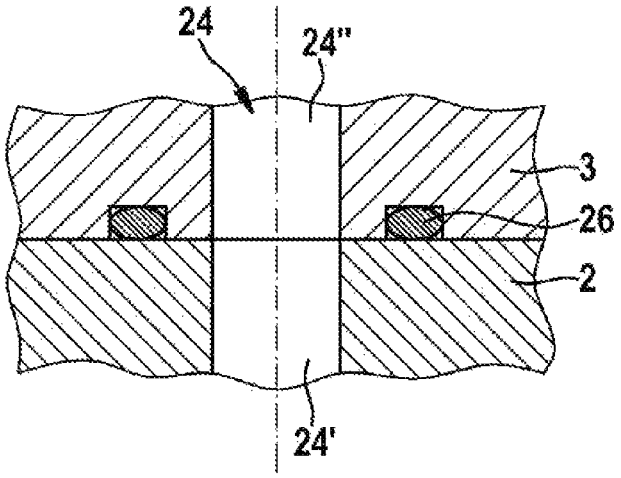
FIGS. 3A to 3C advantageous embodiments of the piston pump, each in a sectional depiction.
Figure 3B:
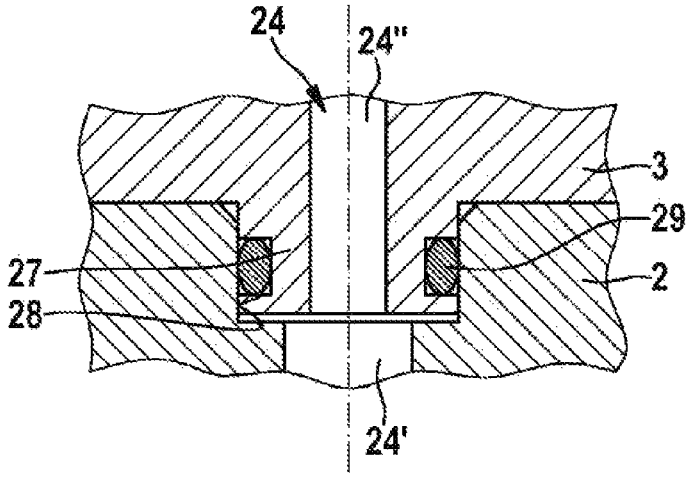
Figure 3C:
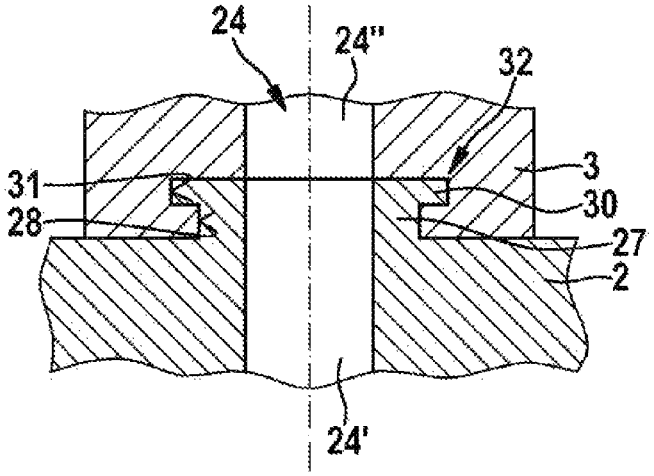

FIGS. 3A to 3C show various exemplary embodiments of the design of the connection of the channels 15, 21 and 16, 22.

FIGS. 3A to 3C show the housing parts 2, 3 in a longitudinal sectional depiction in the region of the bore 24, wherein the bore 25 is suitably formed correspondingly to the bore 24.

According to the first exemplary embodiment of FIG. 3A, it is provided that the housing parts 2, 3 lie flat on each other at their ends. The bore 24 is formed by a bore 24' in the housing 2 and by a bore 24" in the housing part 3. Because the bores 24' and 24" align with each other, they form a continuous bore 24 which is connected at the respective ends to the fluid channels 15 and 21. Because of the design as a bore, the fluidic connection can be achieved in the housing parts in a simple fashion. Suitably, a sealing element in the form of a sealing ring 26 is arranged between the housing parts 2, 3 coaxially to the bore 24, and ensures that hydraulic medium does not escape from the housing parts 2, 3.

The exemplary embodiment in FIG. 3B differs from that of FIG. 3A in that the housing part 3 has, in the region of the bore 24, a protrusion 27 which sits in a depression 28 of the housing part 2. In particular, the outer diameter of the protrusion 27 corresponds at least substantially to the inner diameter of the depression 28, so that the protrusion 27 sits tightly or radially tightly in the depression 28. The tightness may optionally be increased if a sealing element 29, in particular an O-ring such as that previously arranged coaxially to the bore 24, this time however lies radially between the protrusion 27 and the depression 28. In addition or alternatively to the sealing element 29, the sealing element 26 could also be provided between the housing parts 2, 3 as shown in the exemplary embodiment of FIG. 3A.

The exemplary embodiment of FIG. 3C differs from the exemplary embodiment of FIG. 3B in that the protrusion is formed on the housing 2 and the depression 28 on the housing 3. The embodiment of FIG. 3C also differs from that in FIG. 3B in that the protrusion 27 and the depression 28 form an axial undercut 32. For this, at its free end, the protrusion 27 has a radially protruding collar 30 which engages in a corresponding recess 31 of the depression 28. This form fit is achieved because the housing part 3 is plastically deformed at its end facing the housing part 2, in order to engage behind the protrusion 27 axially or in the axial direction of the bore 24. Here too, additionally one or more sealing elements may be provided.

The invention claimed is:

1. A piston pump, comprising:

a piston which is movably mounted in a housing;

a linear actuator configured to move the piston in a first direction; and a return spring configured to move the piston in a second direction, wherein:

the housing includes a first housing portion defining in part a first pressure chamber, and including a first bore, and a second housing portion laying closely against the first housing portion and defining in part a second pressure chamber, the second housing portion including a second bore aligned with the first bore;

an end face of a first end of the piston delimits the first pressure chamber and is assigned to a first hydraulic circuit; an end face of a second end of the piston delimits the second pressure chamber;

the first bore is in fluid communication with the second pressure chamber within the housing through the second bore;

the piston pump is configured such that the piston is moved solely by the linear actuator in the first direction; and the piston pump is configured such that the piston is moved solely by the return spring in the second direction.

2. The piston pump as claimed in claim 1, wherein the linear actuator includes:

an armature fixedly connected to the piston, and a stator arranged stationarily on the housing coaxially to the piston, the stator arranged between the first and second pressure chambers.

3. The piston pump as claimed in claim 1, wherein the piston pump is configured for use in a motor vehicle.

4. The piston pump as claimed in claim 1, wherein each of the first and second pressure chambers has at least one check valve.

5. The piston pump as claimed in claim 1, wherein each of the first and second pressure chambers has a first check valve at an intake port and a second check valve at a pressure port.

6. The piston pump as claimed in claim 1, wherein:

the first and second housing parts enclose the linear actuator.

7. The piston pump as claimed in claim 1, wherein at least one sealing element is assigned to the mutually aligned bores.

8. The piston pump as claimed in claim 7, wherein the at least one sealing element is an O-ring.

9. The piston pump as claimed in claim 1, wherein in a region of the mutually aligned bores, one of the first and second housing parts has a protrusion and the other of the first and second housing parts has a depression corresponding to the protrusion.

10. The piston pump as claimed in claim 9, wherein the protrusion is held in the depression by at least one of force and form fit.

* * * * *